United States Patent [19]

Knox

[11] 4,133,386

[45] Jan. 9, 1979

[54] DRILL PIPE INSTALLED LARGE DIAMETER CASING CEMENTING APPARATUS AND METHOD THEREFOR

[75] Inventor: Lloyd C. Knox, Duncan, Okla.

[73] Assignee: Halliburton Company, Duncan, Okla.

[21] Appl. No.: 751,511

[22] Filed: Dec. 17, 1976

[51] Int. Cl.[2] ..... E21B 23/00; E21B 33/127; E21B 33/129; E21B 33/14

[52] U.S. Cl. ..... 166/285; 166/120; 166/187; 166/212; 166/362

[58] Field of Search ..... 166/285, 289, 290, 120, 166/133, 154, 156, 187, 212

[56] References Cited

U.S. PATENT DOCUMENTS

| | | | |
|---|---|---|---|
| 2,662,599 | 12/1953 | Baker | 166/156 |
| 2,925,865 | 2/1960 | Oliver | 166/154 |
| 3,180,419 | 4/1965 | Cochran et al. | 166/120 |
| 3,391,740 | 7/1968 | Edwards, Jr. | 166/120 |
| 3,503,445 | 3/1970 | Cochrum et al. | 166/187 X |
| 3,524,503 | 8/1970 | Baker | 166/187 X |
| 3,768,556 | 10/1973 | Baker | 166/154 |
| 3,948,322 | 4/1976 | Baker | 166/289 |

*Primary Examiner*—Stephen J. Novosad

*Attorney, Agent, or Firm*—John H. Tregoning; James R. Duzan

[57] ABSTRACT

A method is disclosed for the cementing of casing in a well. The method involves lowering the casing into the wellbore, installing a device on a conduit and thereafter lowering the installed device and conduit to a predetermined position within the casing. The device is then actuated and fluid pressure is applied to the device to interlock the device with either the casing or an adapter previously inserted in the casing. Continued fluid pressure distends a seal member to isolate two regions of the casing. A cementing operation is then performed followed by closure of the device. Preferably, the conduit may then be retrieved for reuse.

A device is disclosed for cementing a casing within a wellbore. The device includes a body for occupying a substantial portion of the interior of a region of the casing. The body is connectable to a conduit thereabove and has an external hydraulic seal to pack off the casing. The body also has an interlock system to interlock with the casing to prevent upper movement of the device during subsequent cementing operations. Appropriate valving is also present in the device to enable the proper sequential actuation of the seal, interlock system and cementing accessories.

16 Claims, 5 Drawing Figures

Figure 1:
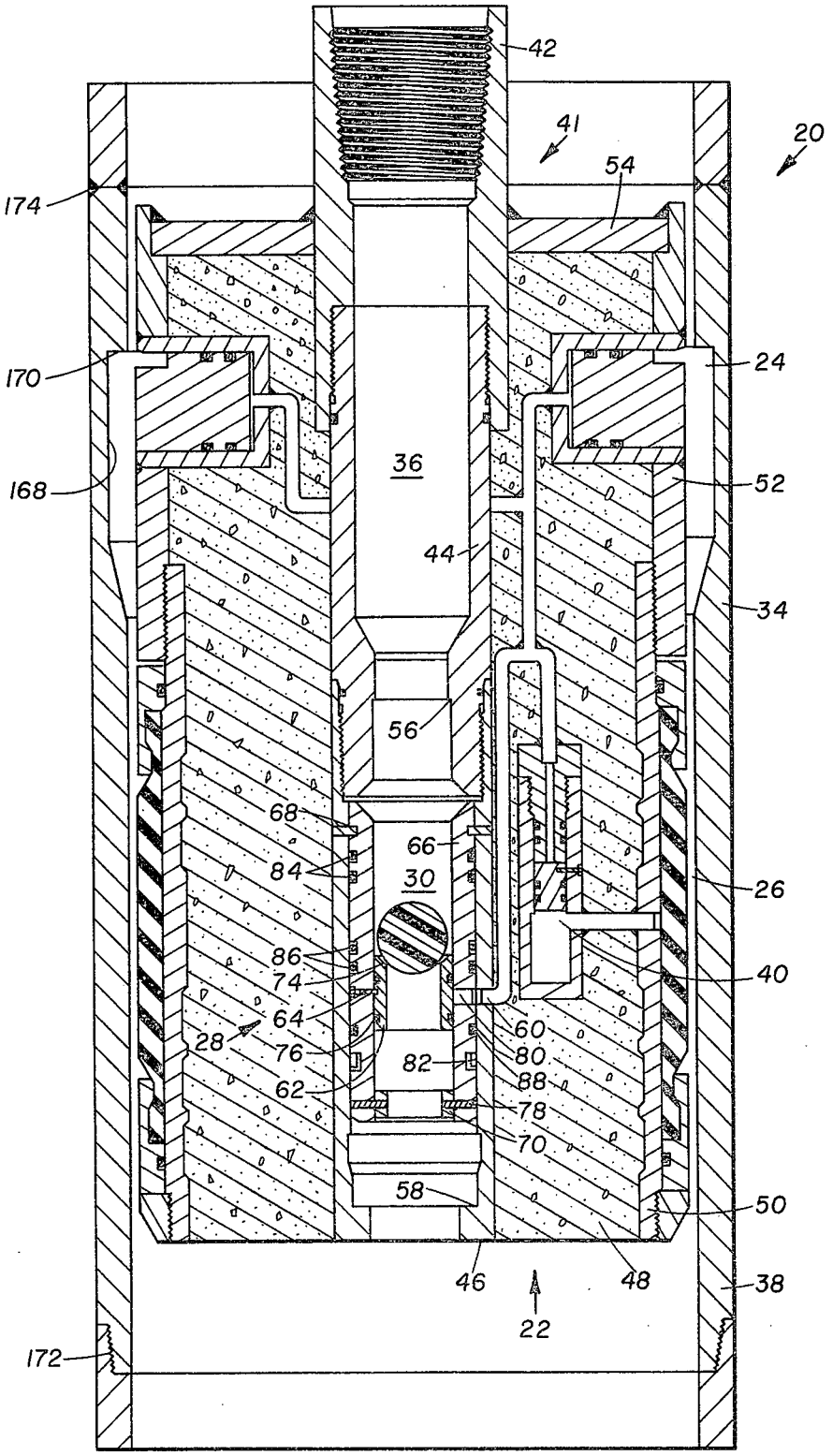

DRILL PIPE INSTALLED LARGE DIAMETER CASING CEMENTING APPARATUS AND METHOD THEREFOR

This invention relates to a method for cementing casing within a wellbore and to apparatus for such cementing operations.

Cementing operations have been performed in wellbores for over fifty years, but cementing tools and methods continue to be improved. With the recent increase in offshore drilling in such areas as the North Sea, special problems have emerged. One such problem is related to the current practice of installing casing in offshore wells. At least one North Sea operator lowers relatively large diameter casing to a position near the ocean floor and then uses this casing as a guide for drilling a wellbore into which the casing is intended to be subsequently installed. Since the casing is used as a guide, and the drill bit utilized for drilling the wellbore must pass through the casing, it is not practical to install cementing equipment such as a float shoe on the casing prior to passing the drill bit through the casing, as such an operation would result in the floating equipment being destroyed by the drill bit as it passed through the casing. Therefore, the current practice has been to pass the drill bit through the casing, drill the wellbore, retrieve the drill bit back through the casing, pass an underreaming device back down through the casing, underream the wellbore to the desired diameter, retrieve the underreaming device back through the casing, pull the casing back to above the ocean's surface, install the floating equipment, relower the casing to the ocean floor, locate the wellbore, insert the casing with floating equipment attached into the wellbore, lower the casing to the desired position within the wellbore and only then to commence the cementing operations. While such a procedure is relatively straightforward and follows in logical sequence, a substantial problem occurs in raising the casing back to the surface, as such an operation necessitates standing the casing back at least a distance equal to the water-depth above the wellbore. This creates a substantial technical problem and causes large time delays. Therefore, floating equipment is needed which could be inserted within the casing and locked in some fashion so that cementing could be commenced without having to pull the casing back to the ocean's surface to install floating equipment.

A solution to these and other problems is provided by the apparatus of this invention.

This invention provides a method for cementing a casing in a wellbore, which comprises the steps of: lowering the casing into the wellbore; installing a device on a conduit; lowering the conduit and installed device within the casing to a position in the casing; pressurizing a first upper internal section of the device to a first predetermined pressure; opening a first passageway in the device when the first predetermined pressure is reached; introducing a first quantity of fluid through the opened first passageway into a second section of the device so as to bias the second section toward interlocking engagement with the casing; vertically manipulating the conduit to firmly engage the biased second section with the casing to thereafter prevent upward movement of the device relative to the casing; pressurizing the first upper internal portion of the device to a second predetermined pressure; opening a second passageway when the second predetermined pressure is reached; introducing a second quantity of fluid into the opened second passageway to expand a third section of the device into sealing contact with the casing to isolate a first interior region of the casing above the seal from a second internal region of the casing below the seal; further pressurizing the first upper internal portion of the device to a third predetermined pressure; closing the first passageway when the third predetermined pressure is reached; further pressurizing the first upper internal portion of the device to a fourth predetermined pressure; opening a third passageway in the device to communicate the conduit with the second region of the casing; introducing a quantity of cement through said opened third passageway into the second region; and thereafter introducing a closure member into the device to close the third passage and prevent fluid flow from second region into the conduit.

An additional method is provided by this invention and comprises the steps of: installing an adapter in the casing; lowering the casing and installed adapter into the wellbore; installing an unactuated device, having a closed passageway therethrough, on a conduit; positioning the conduit and installed device within the casing at a first position adjacent the adapter; actuating the device; pumping fluid through the conduit and into said device so as to interlock a first section of the device with the adapter to restrain the device from upward movement within the casing so as to expand a second section of the device to isolate a first interior region of the casing above the interlocked device from a second internal region of the casing below the interlocked device; actuating a lock mechanism by continued pumping so as to maintain the first and second sections of the device in interlocked and expanded positions, respectively and thereafter open the closed passageway to communicate the second region with the conduit; introducing a quantity of cement through the conduit and opened passageway into the second region; and thereafter closing the passageway.

The invention further provides an apparatus connectable to a conduit for placement within a casing and subsequent cementing of the casing to a surrounding wellbore, comprising: body means, attachable to a lower end of the conduit means, for defining a first passageway therethrough in communication with both the conduit and first region of the casing below the body means and for occupying a substantial portion of an interior area of a second region of the casing surrounding the apparatus; extensible interlock means, attached to said body means and having a second passageway in closed communication with the first passageway, for extending into interlocked engagement with said casing upon opening of the second passageway and subsequent introduction of a quantity of fluid into the second passageway; extensible seal means, sealingly attached to the body means and having a third passageway in closed communication with the first longitudinal passageway, for distending into and sealing the annulus between the body means and the second region of the casing upon opening of the third passageway and introduction of a quantity of pressurized fluid into the third passageway; first valve means, attached to the body means, for opening the second and third passageways upon sealing engagement of a first closure means with said first valve means and subsequent pressurization of the upper portion of the first passageway to at least one predetermined pressure, for closing the second and third passageways upon extension of both the interlock and seal means and for thereafter opening the first passageway; first closure means for movement through the conduit and sealing engagement with the first valve means; and second closure means for moving through said conduit and into sealing engagement with the first passageway to close the first passageway.

Figure 2:
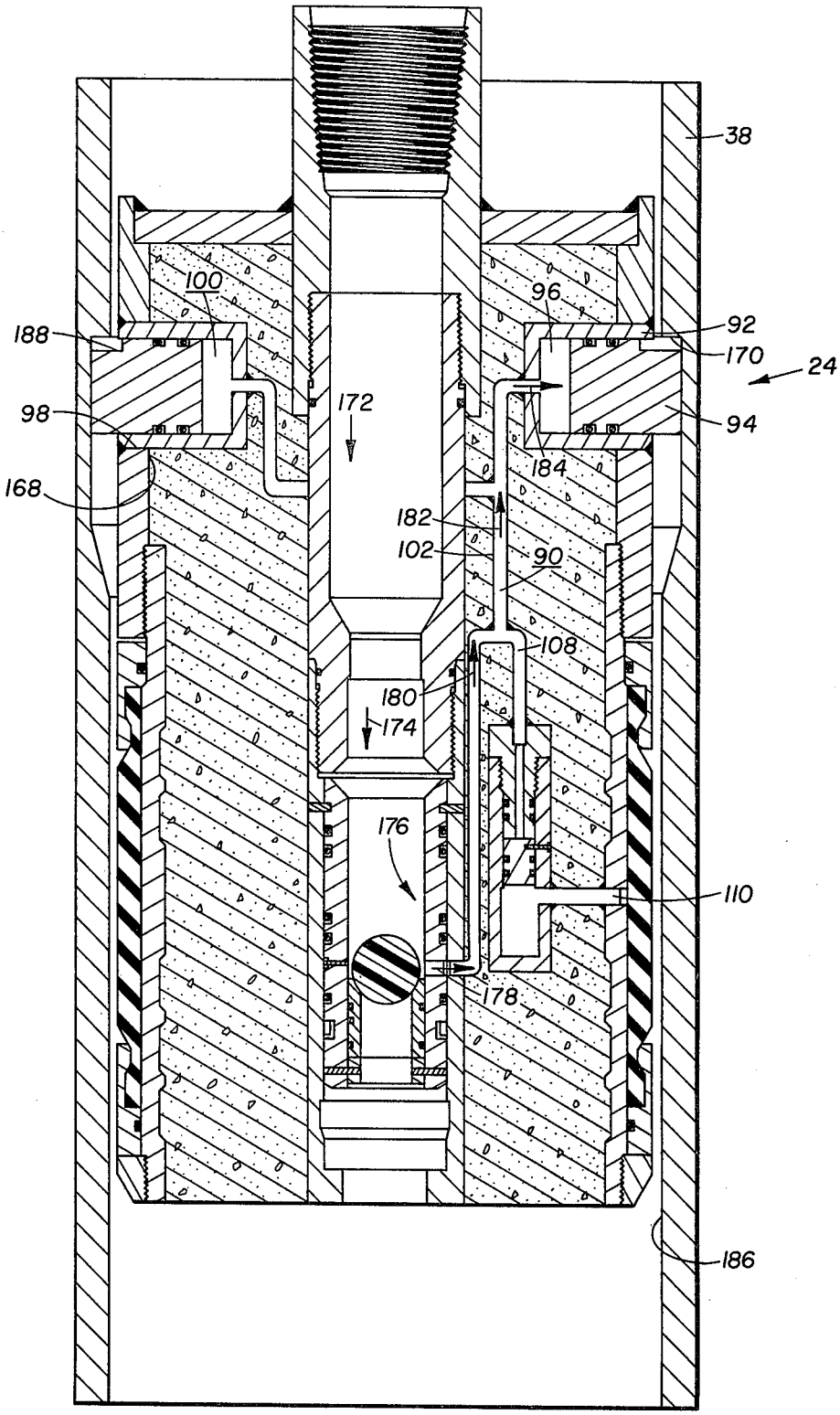
Figure 3:
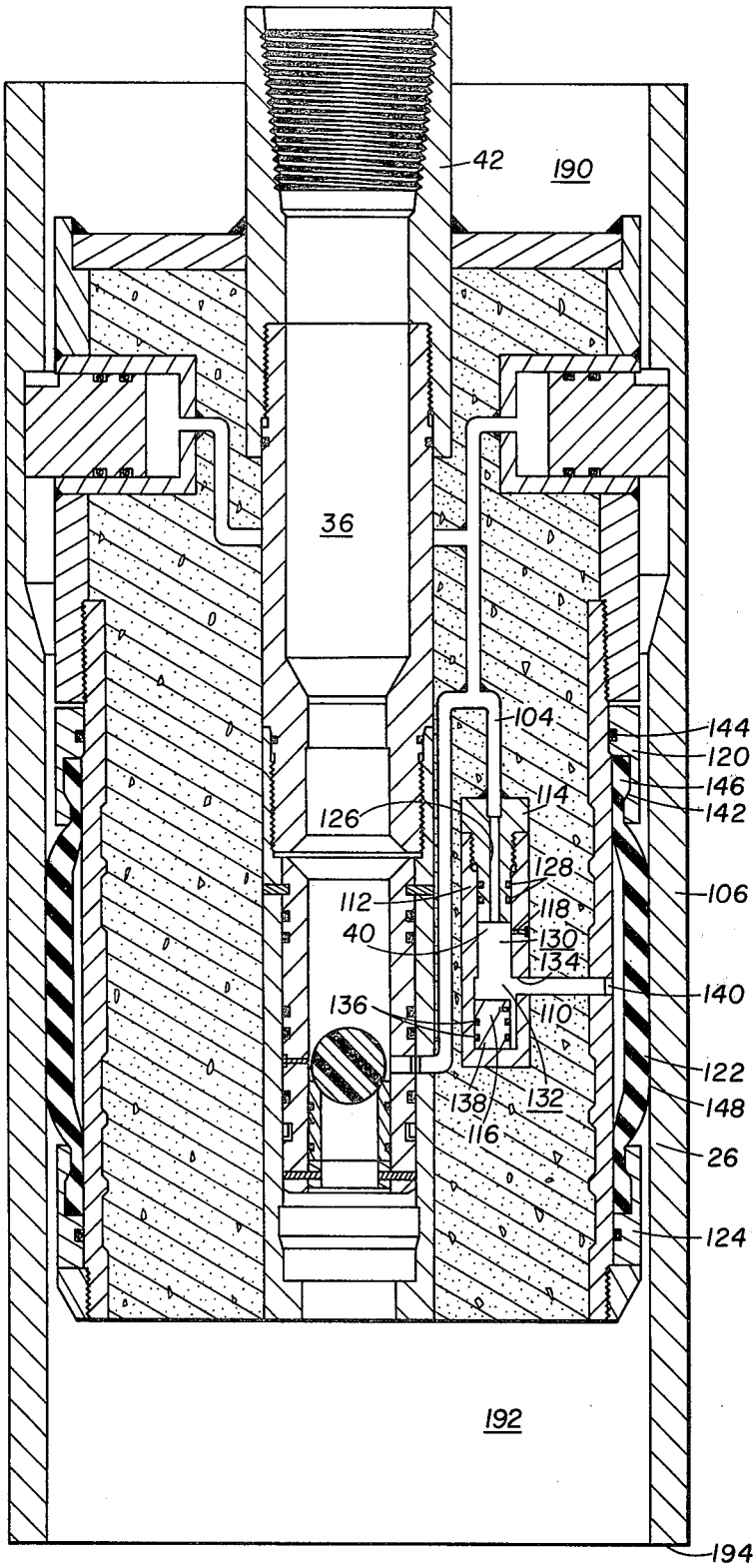
Figure 4:
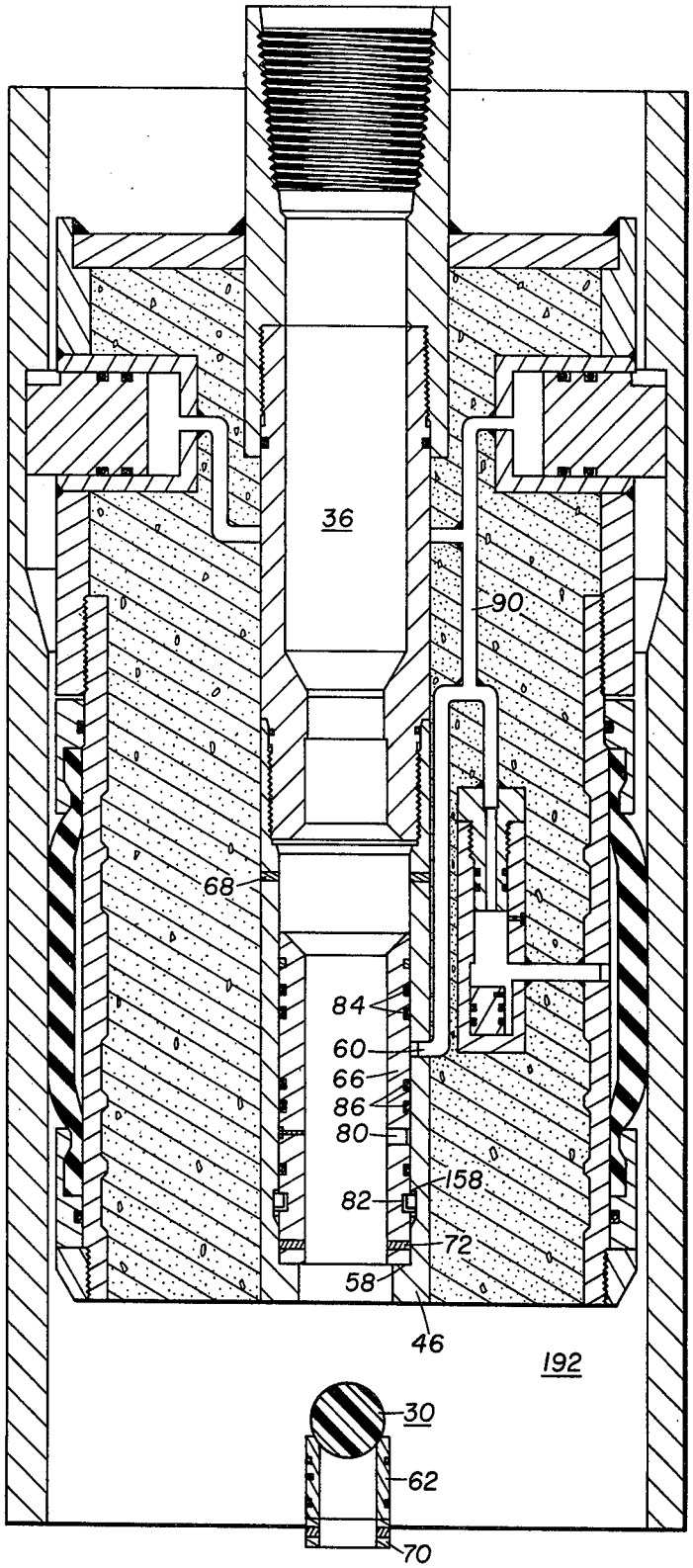
Figure 5:
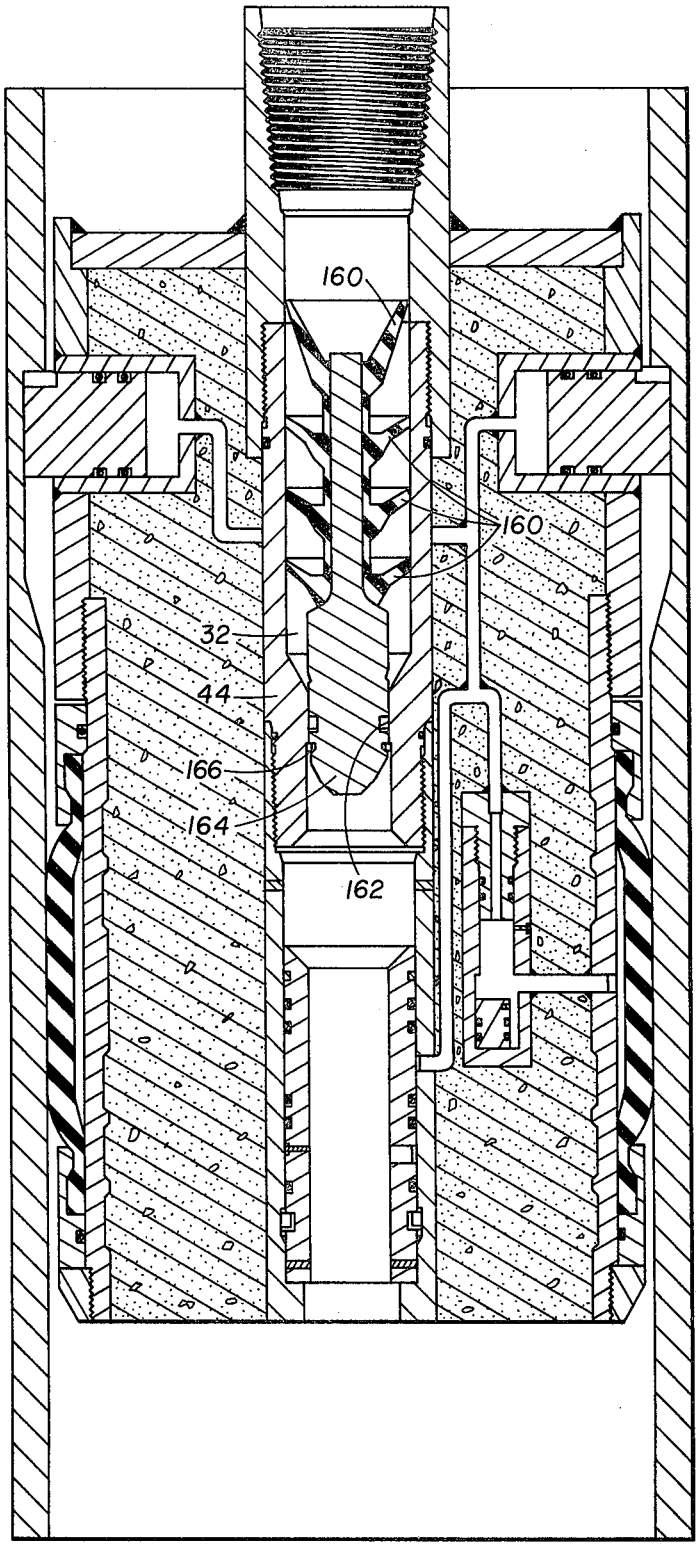

The apparatus of this invention is more fully described in the attached drawings which include:

FIG. 1, a vertical cross-sectional view of a preferred embodiment of the apparatus of the invention in actuated position within a casing;

FIG. 2, a vertical cross-sectional view of the apparatus of FIG. 1 interlocked with the casing;

FIG. 3, a vertical cross-sectional view of the apparatus of FIGS. 1 and 2 in sealed interlocked engagement with the casing;

FIG. 4, a vertical cross-sectional view of the apparatus of FIGS. 1, 2 and 3 in interlocked and sealed engagement with the casing and with an open passageway therethrough; and FIG. 5, a vertical cross-sectional view of the apparatus of FIGS. 1–4 in sealed interlocked engagement with the casing and plugged to prevent fluid passage therethrough.

The afore-mentioned figures merely depict one preferred embodiment of the invention, and by no means depict all embodiments currently envisioned, as will be readily apparent from the following description of the preferred embodiment and its manner of operation.

FIG. 1 is a vertical cross-sectional view of a cementing apparatus 20 which includes a body 22, and interlock means 24, a seal means 26, a first valve means 28, a first closure means 30, and a second closure means 32. The apparatus can further include an adapter means 34 attachable as an integral part of the casing. The body means 22 defines a longitudinal passageway 36 through the cementing apparatus and occupies a substantial portion of the cross-sectional area of a surrounding casing 38. The apparatus 20 can also include a second valve means 40 for purposes described below in connection with the distension of seal means 26. First valve means 28 is located within longitudinal passageway 36 of body means 22 and is utilized in connection with the operation of interlock means 24, seal means 26 and subsequent cementing operations. First closure means 30 is adapted to be disposed within longitudinal passageway 36 and cooperates with first valve means 28 to perform certain operations as described below. Second closure means 32 also is adapted to be disposed within longitudinal passageway 36 and cooperates with a portion of the body means to plug the passageway 36 for reasons described below.

Body means 22 includes connector 42, latch down tube 44, valve tube 46, spacer body 48, lower housing 50, upper housing 52 and upper plate 54. Connector 42 can be any suitable means for connecting the apparatus to a conduit (not shown) thereabove from which pressurized fluid may be introduced into connector 42 and passageway 36. Preferrably connector 42 is a tubular member having internal threads at its upper and lower ends. Latch down tube 44 is a tubular member having external upper threads connected to the lower threads of connector 42 and having lower external threads. Valve tube 46 is also a tubular member and is provided with internal threads on its upper end for connection with the lower external threads of latch down tube 44. Connector 42, latch down tube 44 and valve tube 46 are connected end-to-end and define a longitudinal passageway 36 therethrough. Latch down tube 44 includes a downwardly facing annular shoulder 56 for purposes described below. Valve tube 46 has an upwardly facing shoulder 58 and at least one radial opening 60 thereabove. Spacer body 48 surrounds tubes 44 and 46 and lower housing 50 and upper housing 52 in turn surround spacer body 48. Upper plate 54 serves to connect the upper end of upper housing 52 with the central tube 41 defined by connector 42, latch down tube 44 and valve tube 46. The overall appearance of body means 22 is thus much like a thick-walled cylinder.

First valve means 28 includes an inner tubular opening sleeve 62, a first shear pin 64, a second outer tubular opening sleeve 66, a second shear pin 68, a third tubular inner releasing sleeve 70 and a third shear pin 72. Opening sleeve 62 is a tubular member having an upper tapered end providing a landing surface 74, a pair of vertically spaced external recesses adapted to receive seals 76 and 78 and an external recess for receiving an inner end of shear pin 64. First shear pin 64 releasably attaches sleeve 62 and sleeve 66. Closing sleeve 66 encircles opening sleeve 62 and includes lateral port 80, an expansive external snap ring 82, at least one upper external seal 84, at least one middle external seal 86, and at least one lower seal 88. Releasing sleeve 70 is connected by shear pin 78 to the lower end of closing sleeve 66 in such a manner that opening sleeve 62 is prevented from moving downwardly out of the lower end of closing sleeve 66 until such time as shear pin 78 has sheared. Seals 84 and 86 are vertically spaced above lateral port 80 and seal 88 is located below port 80. Sleeve 66 is positioned within valve tube 46 in such a manner that port 80 and opening 60 are in fluid communication and seals 86 and 88 prevent fluid from entering opening 60 from between opening sleeve 66 and valve tube 46. Shear pin 68 serves to releasably attach closing sleeve 66 to valve tube 46 with port 80 and opening 60 aligned. Snap ring 82 serves to engage valve tube 46 upon shearing of shear pin 68 and downward movement of closing sleeve 66 within valve tube 46 and thereafter restrain upward movement of closing sleeve 66 within valve tube 46. Sleeve 62, with seals 76 and 78 serve to prevent fluid from entering port 80 until shear pin 64 has sheared and opening sleeve 62 moved downwardly within closing sleeve 66, as seen in FIG. 2.

Referring now to FIG. 2, interlock means 24 includes a second passageway 90, a cylinder 92 and a latch piston 94. Passageway 90 communicates at a first end with opening 60 and at a second end with an opening 96 in cylinder 92. Cylinder 92 opens outwardly and extends through an opening 98 in upper housing 52. Latch piston 94 is positioned in the open outer end of cylinder 92 and together with cylinder 92 defines a latch chamber 100 which communicates with opening 96 and serves to expansively drive latch piston 94 outward to an engagement with casing 38 upon introduction of fluid into chamber 100. Passageway 90 can be lined with a suitable liner 102 to facilitate construction of apparatus 20.

Referring now to FIG. 3, seal means 26 includes third passageway 104, second valve means 40 and packer assembly 106. Second valve means 40 is positioned within passageway 104 and divides passageway 104 into entrance portion 108 and exit portion 110. Second valve means 40 includes seal cylinder 112, a seal cylinder cap 114, a seal plug 116 and a fourth shear pin 118. Packer assembly 106 includes upper shoe 120, packer element 122 and lower shoe 124. Entrance portion 108 connects seal cylinder cap 114 with second passageway 90. Cap 114 includes cap passageway 126 and cap seals 128. Passageway 126 serves to connect entrance passageway 108 with the interior of cylinder 112 and cap seals 128 serve to seal between cylinder 112 and cap 114. Seal cylinder 112, which is sealingly connected to cap 114, includes an upper plug cavity 130, a lower plug cavity 132 and a seal cylinder port 134 which is preferably located between cavities 130 and 132. Upper cavity 130 is in fluid communication with cap passageway 126, while lower cavity 132 is in fluid communication with exit passageway 110 by means of seal cylinder port 134. Seal plug 116 is a cylindrical body and includes at least one seal plug seal 136 for sealing between body 138 of seal plug 116 and seal cylinder 112 during such time as seal plug 116 is disposed within upper plug cavity 130. Fourth shear pin 118 serves to position seal plug 116 within upper seal plug cavity 130 until such time as a predetermined pressure exists in cap passageway 126 and the upper end of seal plug cavity 130 in communication therewith and to release seal plug 116 when such pressure is reached to open communication between cap passageway 126 and exit passageway 110. Lower seal plug cavity 132 serves to receive the released seal plug 116 and to hold seal plug 116 in a position out of the flow path from cap passageway 126 through upper seal plug cavity 130 through seal cylinder port 134 and into exit passageway 110. Exit passageway 110 communicates seal cylinder port 134 with a packer chamber 140 defined by the inside surface of packer element 122 and the external surface of lower housing 50. Upper shoe 120 is a ring-shaped body having a lower internal recess 142 and an internal upper shoe seal 144. Packer element 122 includes an upper end 146 a central portion 148 and a lower end 150. Lower shoe 124 is a ring-shaped member and includes an upper internal lower shoe recess 152 and an internal seal 154 therebelow. Upper shoe 120, packer element 122 and lower shoe 124 all lie within an external recess 156 of lower housing 50 so as to maintain them attached to body means 20. Recesses 142 and 152 serve to sealingly receive ends 146 and 150, respectively, of packer element 122. Upper shoe 120 is preferably attached to lower housing 50 while lower shoe 124 is preferably slidable upon lower housing 50 in order to allow for vertical contraction of packer element 122 during distension of packer element 122.

Referring now to FIG. 4, it is seen that first closure means 30 can be a solid ball of diameter greater than the internal diameter of opening sleeve 62 but less diameter than the internal diameter of closing sleeve 66 and valve tube 46. Valve tube 46 preferably includes a downwardly facing internal snap shoulder 158 for interlocking with snap ring 82 upon downward movement of closing sleeve 66.

Referring now to FIG. 5, second closure means 32 can preferably be a conventional latch down plug such as that shown on page 2862 of HALLIBURTON SERVICES Sales and Service Catalog — No. 38 (January 1976) which includes wipers 160, seal 162, snap ring 166 and body portion 164. Wipers 160 serve to maintain separation of cement or other fluid therebelow from a fluid thereabove and to wipe the interior of the conduit (not shown) attached to connector 42. Snap ring 166 serves to maintain second closure means 32 within latch down tube 44 and seals 162 serve to seal between valve tube 44 and body portion 164 to prevent fluid movement through latch down tube 44 after second closure means 32 has seated therein.

Referring again now to FIG. 1, adapter 34 is a tubular conduit having an internal downwardly facing annular shoulder 170 and preferably also including an internal recess 168 immediately below shoulder 170. Adapter 34 can be connected as an integral part of casing 38 by suitable means such as threads 172, welded connection 174 or even a slip joint (not shown).

The operation of apparatus 20 will now be described. Adapter 34 is first installed as an integral part of casing 38 to provide a downwardly facing shoulder 170 for attachment of apparatus 20. Alternately, casing 38 may be utilized without adapter 34 if latch piston 94 is operably connected to suitable slip means for gripping engagement with the internal wall of casing 38. Casing 38 can then be lowered to a position immediately above a surface to be drilled or can be lowered directly into a previously drilled wellbore. In the event the wellbore has not been previously drilled, a suitable drilling bit may be passed through casing 38 and into the earth therebelow to form a wellbore. In such an operation casing 38 could serve as a guide to maintain the proper orientation of the drilling bit. The drilling bit can then be raised back up through the casing 38 and an under reamer substituted for the drill bit, the under reamer then being passed back through the casing 38, utilizing casing 38 again as a guide, to enlarge the previously drilled wellbore to a size suitable for receiving casing 38. The under reamer would then be raised back through casing 38 and apparatus 20 would be attached to the end of the drill pipe in place thereof. Casing 38 is lowered into the wellbore to a predetermined position either resting on the bottom of the wellbore or hung at some suitable point thereabove. Apparatus 20 is then lowered on a suitable conduit, such as drill pipe, to a position at or below recess 168 of adapter 34. If no adapter 34 is used, apparatus 20 is lowered to a position at or near the bottom of casing 38. Further discussion of the operation of apparatus 20 will assume that an adapter 34 is utilized. It will be understood that adapter 34 can be eliminated if hydraulic slips are utilized in apparatus 20.

With apparatus 20 now in position, a first closure means 30, such as a round weighted ball, is inserted into the conduit and pumped downwardly or allowed to fall downwardly until it lands in opening sleeve 62. The design of opening sleeve 62 is such that first closure means 30 will substantially seal opening sleeve 62 and prevent fluid passage therethrough. Continued pumping will therefore result in pressurization of longitudinal passageway 36 and a pressure differential across opening sleeve 62 which produces a downward force upon opening sleeve 62. This downward force is transferred to shear pin 64 and when a predetermined pressure is reached in longitudinal passageway 36, shear pin 64 will shear to allow downward movement of opening sleeve 62 within closing sleeve 66 to the position seen in FIG. 2. This downward movement results in upper seal 76 passing below port 80 and thereby allows communication from longitudinal passageway 36 through port 80 and opening 60 into passageway 90 and through passageway 90 into chamber 100 as indicated by arrows 172, 174, 176, 178, 180, 182 and 184. Continued pumping will therefore cause the expansion of chamber 100 in response to the introduction of fluid into chamber 100, resulting in the outward extension of latch piston 94 into contact with casing 38. This contact would preferably occur at some point 186 below recess 168. Cementing apparatus 20 would then be raised until cementing apparatus was approximately in the position indicated in FIG. 2, at which time the pressure in longitudinal passageway 36 and chamber 100 would cause latch piston 94 to fully extend into recess 168 and interlock with shoulder 170 of adapter 34 so as to prevent further upward movement of cementing apparatus 20 within casing 38. Latch piston 94 may include an upper recess 188 to conform to shoulder 170 for better engagement therewith.

Referring now to FIG. 3, continued pumping of fluid into passageway 36 will result in pressurization of entrance portion 108 of third passageway 104 and pressurization of cap passageway 126. This pressure will be transmitted to the upper surface of seal plug 116 resulting in a downward force on seal plug 116 which is transferred to shear pin 118. When this pressure reaches a predetermined magnitude, shear pin 118 shears to allow shear plug 116 to fall from upper plug cavity 130 into lower plug cavity 132 and thereby open seal cylinder port 134 to allow fluid passage into exit passageway 110 and therethrough into packer chamber 140 to inflate packer element 122 into sealing engagement with the interior wall of casing 38. The lower end 152 of packer element 122 is free to move upwardly in response to vertical shortening of packer element 122, since lower packer shoe 124 is slidable upon lower housing 50. The sealing contact of packer element 122 with the interior wall of casing 38 together with seals 144, 154 and body means 22 isoiate a region 190 internal of casing 38, external of connector 42 and the conduit (not shown) attached thereto and above apparatus 20 from a second region internal of casing 38 and below cementing apparatus 20. Second region 192 is in communication with the lower end 194 of casing 38 so as to allow subsequent cementing operations.

Referring now to FIG. 4, continued pumping of fluid into longitudinal passageway 36 following complete distension of packer element 122 will result in additional downward pressure upon opening sleeve 62, which after downward movement rests upon releasing sleeve 70 which is attached to closing sleeve 66 by shear pin 72. Thus, the downward force upon opening sleeve 62 is transferred through releasing sleeve 70 to opening sleeve 66. When the pressure in longitudinal passageway 36 reaches a predetermined level the downward force transferred to opening sleeve 66 is sufficient to shear pin 68 and allow downward movement of closing sleeve 66 until sleeve 66 comes in contact with shoulder 58 of valve tube 46 at which time further downward movement of closing sleeve 66 is restrained and snap ring 82 is free to expand into interlocking engagement with snap shoulder 158 of valve tube 46. This downward movement of closing sleeve 66 results in port 80 moving out of alignment with opening 60 and seals 86 move into a position between port 80 and opening 60 to prevent fluid passage therebetween. Seal 84 is also provided to prevent movement of fluid from passageway 36 outside of closing sleeve 66 and into opening 60. Therefore, passageway 90 is effectively isolated from longitudinal passageway 36 and interlock means 24 and seal means 26 are hydraulically locked in their extended positions. Continued pumping of fluid into longitudinal passageway 36 will thereafter result in additional downward force upon opening sleeve 62 which will be in turn transmitted to releasing sleeve 70 and shear pin 72. When this pressure reaches a predetermined level, which level must be higher than the level required for the shearing of pin 68, shear pin 72 will shear to release releasing sleeve 70 for downward movement along with opening sleeve 62 out of the lower end of closing sleeve 66 and into second region 192. When this occurs longitudinal passageway 36 is fully opened through the cementing apparatus to allow cement to pass downwardly through longitudinal passageway 36 into second region 192 downwardly under the lower end 194 of casing 38 and upperwardly through an annulus between the casing 38 and a surrounding wellbore to allow for cementing of casing 38 to the surrounding wellbore. Suitable cementing operations would occur utilizing as many bottom plugs as desired below or above the cement.

A second closure means 32 would be pumped downwardly through the conduit above the cement and any upper bottom plugs. Second closure means 32 would move downwardly into longitudinal passageway 36 and seat in valve tube 44 to prevent fluid passage through longitudinal passageway 36. Suitable seals 162 and a snap ring 166 could be provided to facilitate the latching and sealing of second closure means 32 within valve tube 44.

Having now completed the cementing operation the conduit would now be preferably disconnected from connector 42 and the conduit retrieved upwardly through casing 38 leaving cementing apparatus 20 in position within the casing 38. At such time as the cement had sufficiently set, drilling operations could be resumed. Cementing apparatus 20 would be constructed of drillable materials so as to allow it to be drilled out of casing 38.

As noted above, the foregoing description is intended only to depict a preferred embodiment by which Applicant intends to practice his invention. Many modifications will be readily apparent to one of ordinary skill in the art, and a few such modifications will be now discussed by way of example only. Other modifications will suggest themselves to those of ordinary skill in the art and will not be discussed in any detail herein. Aa depicted in the drawings, all seals utilized in cementing apparatus 20 are O-rings, but any suitable seals could be utilized in their place. Latch piston 94 is shown with a flat external surface in order to facilitate upward sliding movement thereof with respect to casing 38 from point 186 to shoulder 170. In the event that recess 168 or shoulder 170 was eliminated, latch piston 94 could have external slips or could be operably connected to a suitable body for gripping engagement of casing 38. While cementing apparatus 20 is shown with the pressurization all occurring through a single longitudinal passageway 36, the inflation could occur through a separate inflation line leading into passageway 90. The preferred apparatus has the advantage that a second inflation line is not needed, although such could be readily employed. Cylinder 92 could have an external flange to prevent latch piston 94 from moving completely out of cylinder 92. Spacer body 48 is also optional, and is employed to give cementing apparatus 20 more rigidity. If spacer body 48 were eliminated, an additional plate would be needed to seal the lower end of cementing apparatus 20 between valve tube 46 and lower housing 50, however such could be readily employed. While shear pins 64, 68, 72 and 118 are utilized, any other suitable releasing means such as a collet spring or tension collar could be readily substituted. While third passageway 104 is shown connected to passageway 90 rather than directly into first passageway 36, third passageway 104 could be directly connected into passageway 36 with suitable modification of valve means 28. The advantage to having third passageway 104 connect to passageway 90, rather than passageway 36, is that only a single opening 60 is required and further that third passageway 104 cannot be pressurized prior to pressurization of chamber 100 and the resultant extension of latch piston 94, thus insuring that packer element 122 will not be brought into sealing contact with casing 38 until such time as interlock means 24 has interlocked with casing 38 to position cementing apparatus 20. This sequential operation of interlock means 24 and seal means 26 allows for upward pressures upon apparatus 20 to be borne by interlock means 24 and casing 38 rather than seal means 26.

Many other modifications will suggest themselves to those of ordinary skill in the art and the following claims are to be interpreted to cover the broad range of equivalence to which they are entitled.

I claim:

1. A method for cementing a casing in a wellbore, which comprises the steps of:

(a) lowering the casing into the wellbore;
(b) installing a device on a conduit;
(c) lowering the conduit and installed device within the casing to a position in the casing;
(d) pressurizing a first upper internal section of the device to a first predetermined pressure;
(e) opening a first passageway in the device when the first predetermined pressure is reached;
(f) introducing a first quantity of fluid through the opened first passageway into a second section of the device so as to bias the second section toward interlocking engagement with the casing;
(g) vertically manipulating the conduit to firmly engage the biased second section with the casing to thereafter prevent upward movement of the device relative to the casing;
(h) pressurizing the first upper internal portion of the device to a second predetermined pressure;
(i) opening a second passageway when the second predetermined pressure is reached;
(j) introducing a second quantity of fluid into the opened second passageway to expand a third section of the device into sealing contact with the casing to isolate a first interior region of the casing above the seal from a second internal region of the casing below the seal;
(k) further pressurizing the first upper internal portion of the device to a third predetermined pressure;
(l) closing the first passageway when the third predetermined pressure is reached;
(m) further pressurizing the first upper internal portion of the device to a fourth predetermined pressure;
(n) opening a third passageway in the device to communicate the conduit with the second region of the casing;
(o) introducing a quantity of cement through said opened third passageway into the second region; and
(p) thereafter introducing a closure member into the device to close the third passageway and prevent fluid flow from the second region into the conduit.

2. The method of claim 1, further comprising the step, prior to step (a) of:

passing a well boring means through the casing to create a wellbore below said casing.

3. The method of claim 1, further comprising the steps, prior to step (a) of:

(a′) lowering a casing to a position above an ocean floor; and
(a″) passing a well boring means through the casing to create a wellbore therebelow.

4. The method of claim 1, further comprising the step of:

retrieving said conduit while maintaining said device firmly engaged in said casing and while maintaining said third passageway closed.

5. A method for cementing a casing in a wellbore, which comprises the steps of:

(a) installing an adapter in the casing;
(b) lowering the casing and installed adapter into the wellbore;
(c) installing an unactuated device, having a closed passageway therethrough, on a conduit;
(d) positioning the conduit and installed device within the casing at a first position adjacent the adapter;
(e) actuating the device;
(f) pumping fluid through the conduit and into said device so as to interlock a first section of the device with the adapter to restrain the device from upward movement within the casing so as to expand a second section of the device to isolate a first interior region of the casing above the interlocked device from a second internal region of the casing below the interlocked device;
(g) actuating a lock mechanism by continued pumping so as to maintain the first and second sections of the device in interlocked and expanded positions, respectively and thereafter open the closed passageway to communicate the second region with the conduit;
(h) introducing a quantity of cement through the conduit and opened passageway into the second region; and
(i) thereafter closing the passageway.

6. The method of claim 5, further comprising the step, after step (a) and prior to step (b), of:

passing a well boring means through the casing to create a wellbore below the casing.

7. The method of claim 5, further comprising the steps, subsequent to step (a) and prior to step (b) of:

(a′) lowering a casing to a position above an ocean floor; and
(a″) passing a well boring means through the casing to create a wellbore therebelow.

8. The method of claim 5, further comprising the step of:

retrieving said conduit while maintaining said device firmly engaged in said casing and while maintaining said third passageway closed.

9. Apparatus connectable to a conduit for placement within a casing and subsequent cementing of the casing to a surrounding wellbore, comprising:

(a) body means, attachable to a lower end of the conduit means, for defining a first passageway therethrough in communication with both the conduit and a first region of the casing below the body means and for occupying a substantial portion of an interior area of a second region of the casing surrounding the apparatus;
(b) extensible interlock means, attached to said body means and having a second passageway in closed communication with the first passageway, for extending into interlocked engagement with said casing upon opening of the second passageway and subsequent introduction of a quantity of fluid into the second passageway;

(c) extensible seal means, sealingly attached to the body means and having a third passageway in closed communication with the first longitudinal passageway, for distending into and sealing the annulus between the body means and the second region of the casing upon opening of the third passageway and introduction of a quantity of pressurized fluid into the third passageway;

(d) first valve means, attached to the body means, for opening the second and third passageways upon sealing engagement of a first closure means with said first valve means and subsequent pressurization of the upper portion of the first passageway to at least one predetermined pressure, for closing the second and third passageways upon extension of both the interlock and seal means and for thereafter opening the first passageway;

(e) first closure means for movement through the conduit and sealing engagement with the first valve means; and (f) second closure means for moving through said conduit and into sealing engagement with the first passageway to close the first passageway.

10. The apparatus of claim 9, further comprising:

second valve means, in the third passageway, for maintaining the third passageway closed until a predetermined pressure is reached in the second passageway and for opening the third passageway when the predetermined pressure is reached in the second passageway.

11. The apparatus of claim 10, wherein:

the interlock means includes latch means for extending into a recess in the interior wall of the casing and interlocking with the recess to limit upward movement of the apparatus relative to the casing.

12. The apparatus of claim 11, wherein:

the latch means includes a piston and cylinder means for defining a closed chamber in communication with the second passageway and for distending in response to expansion of the chamber.

13. The apparatus of claim 10, wherein:

said third passageway is in closed communication with said second passageway; and said second valve means opens the closed communication between the second and third passageway.

14. The apparatus of claim 9, wherein:

the interlock means includes latch means for extending into a recess in the interior wall of the casing and interlocking with the recess to limit upward movement of the apparatus relative to the casing.

15. The apparatus of claim 14, wherein:

the latch means includes a piston and cylinder means for defining a closed chamber in communication with the second passageway and for distending in response to expansion of the chamber.

16. The apparatus of claim 9, wherein:

the apparatus further comprises an adapter means having a recess for inclusion as an integral part of the casing; and the interlock means includes a latch means for latching into the recess of the adapter to prevent movement of the body means relative to the casing.

* * * * *